US005970926A

United States Patent [19]

Tsunoda et al.

[11] Patent Number: 5,970,926

[45] Date of Patent: Oct. 26, 1999

[54] ENGINE COOLING SYSTEM FOR OUTBOARD MOTOR

[75] Inventors: Masaki Tsunoda; Tetsu Wada, both of Wako, Japan

[73] Assignee: Honda Giken Kogyo Kabushiki Kaisha, Tokyo, Japan

[21] Appl. No.: 09/015,598

[22] Filed: Jan. 30, 1998

[30] Foreign Application Priority Data

Feb. 3, 1997 [JP] Japan ..... 9-020835

[51] Int. Cl.[6] ..... F01P 3/00

[52] U.S. Cl. ..... 123/41.29; 123/41.08; 123/195 P; 440/88; 440/900

[58] Field of Search ..... 123/41.08, 41.09, 123/41.74, 195 P, 41.29; 440/88, 900

[56] References Cited

U.S. PATENT DOCUMENTS 4,312,304 1/1982 Tyner ..... 123/41.74

5,036,804 8/1991 Shibata ..... 123/41.74

5,109,809 5/1992 Fujimoto ..... 123/41.08

FOREIGN PATENT DOCUMENTS 3-168353 7/1991 Japan .

*Primary Examiner*—Noah Kamen

*Attorney, Agent, or Firm*—Merchant & Gould P.C.

[57] ABSTRACT

An engine includes first exhaust passages formed in a cylinder head, a second exhaust passage formed in a cylinder block and communicating with the first exhaust passages, and a cooling water passage having water jacket portions formed around combustion chambers. The cooling water passage includes a first water jacket and a second water jacket. The cylinder head and the cylinder block are fixedly connected together by bolts. The second exhaust passage opens at a joining surface of the cylinder block along cylinders, which opening is surrounded by the bolts. The cooling water passage has water jacket portions formed between the bolts in the joining surface of the cylinder block such that they surround the opening of the block exhaust passage.

4 Claims, 14 Drawing Sheets

ENGINE COOLING SYSTEM FOR OUTBOARD MOTOR

BACKGROUND OF THE INVENTION

1. Field of the Invention

The present invention relates to an improvement in an engine cooling system for an outboard motor.

2. Description of the Related Art

Conventionally, an engine cooling system is known from Japanese Patent Laid-Open Publication No. HEI 3-168353 entitled "Exhaust Passage for Internal Combustion Engine".

As shown in FIGS. 2 and 4 of the publication, the disclosed engine cooling system includes a cylinder head, a cylinder block with a plurality of cylinders arranged generally horizontally in vertical juxtaposition, and a water jacket provided to surround the cylinders. An elongate second exhaust passage, opening along the cylinders, is provided at a joining surface of the cylinder block at which it is to be joined with the cylinder head. The water jacket is arranged at the joining surface of the cylinder block such that it substantially surrounds the opening of the second exhaust passage.

The known system, however, has a drawback in that no part of the water jacket is present as part of an outer wall of the second exhaust passage. The result is that the temperature of that part of the wall of the second exhaust passage temporarily rises undesirably.

SUMMARY OF THE INVENTION

It is an object of the present invention to provide an engine cooling system capable of uniformly cooling an engine.

According to a first aspect of the present invention, there is provided an engine cooling system for an outboard motor, which comprises: a cylinder block having a plurality of cylinders disposed generally horizontally in vertical juxtaposition; a cylinder head being capable of coupling with the cylinder block; a plurality of combustion chambers defined within the cylinder block and the cylinder head; first exhaust passages formed in the cylinder head for guiding an exhaust gas from the combustion chambers; a second exhaust passage formed in the cylinder block in such a manner as to communicate with the first exhaust passages; a first water jacket having jacket portions formed around the combustion chambers of the cylinder head; a second water jacket having jacket portions formed around the combustion chambers of the cylinder block; a cooling water passage comprising the first water jacket and the second water jacket, the cylinder block and the cylinder head having joining surfaces to be connected together by plural bolts; the second exhaust passage having an opening which opens at the joining surface of the cylinder block along the cylinders and is surrounded by the bolts; and the cooling water passage having water jacket portions formed between the bolts in the joining surface of the cylinder block such that they surround the opening of the second exhaust passage.

By virtue of the cooling water passage with the water jacket portions formed between the bolts in the joining surface of the cylinder block such that they surround the second exhaust passage opening, it becomes possible to substantially uniformly cool the vicinity of the opening of the exhaust passage.

According to a second aspect of the present invention, there is provided an engine cooling system for an outboard motor, which comprises: a cylinder block having a plurality of cylinders disposed generally horizontally in vertical juxtaposition; a cylinder head for coupling with the cylinder block to define a plurality of combustion chambers; first exhaust passages formed in the cylinder head for guiding an exhaust gas from the combustion chambers; a second exhaust passage formed in the cylinder block and communicating with the first exhaust passages; a second water jacket having jacket portions for cooling the vicinity of the second exhaust passage; a first water jacket having jacket portions for cooling the vicinity of the first exhaust passages; and a relief valve actuated to open and close the second water jacket and the first water jacket by detecting the pressure of cooling water inside the water jackets, wherein that portion of the second water jacket which surrounds an upper side of the second exhaust passage, and that portion of the first water jacket which surrounds an upper side of the first exhaust passage communicate with a drainage passage provided downstream of the relief valve.

In the arrangement according to the second aspect of the invention, when the relief valve is opened to allow the cooling water to flow through the drainage passage downstream thereof, the cooling water flows into the jacket portions surrounding the upper side of the exhaust passages. The jacket portions are sufficiently cooled by the flowing cooling water that a sufficient cooling effect can be attained throughout the entire area of the joining surfaces around the block and first exhaust passages. Consequently, it becomes possible to produce a uniform temperature distribution at the wall defining the exhaust passage and to maintain at a uniform temperature portions along the joining surfaces of the cylinder block and the cylinder head.

Even when the cooling water has a low temperature with the engine operated at a low speed for a long time and the temperature of an exhaust gas abruptly rises by high speed running of the engine, the relief valve may be opened so that the jacket portions surrounding the upper side of the exhaust passage can be cooled by the cooling water flowing from the valve, thereby increasing the cooling effect over the entire area of the joining surfaces around the exhaust passage.

In a preferred form, the first water jacket further serves to cool the vicinity of the combustion chambers of the cylinder head and has at least one thermostat mounted thereto and being capable of opening and closing actions by detecting a temperature of the cooling water within the first water jacket. In addition, a drainage passage is provided downstream of the thermostat such that it communicates with the drainage passage positioned downstream of the relief valve. Thus, the temperature of the cooling water in the first water jacket is controlled preferentially by the thermostat. As a result, it becomes possible to further improve the cooling effect with respect to the cylinder head by normally feeding a large, predetermined quantity of cooling water to the first water jacket.

The jacket portion of the second water jacket, which surrounds the upper side of the second exhaust passage, preferably has an upper wall positioned lower than an upper wall defining an uppermost one of the cylinders. This makes it unnecessary for the cylinder block to have a large height so as to provide the jacket portions. The engine can thus be kept small, notwithstanding the jacket portion provided thereto for surrounding the upper side of the second exhaust passage.

BRIEF DESCRIPTION OF THE DRAWINGS

A preferred embodiment of the present invention will be described in detail hereinbelow, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
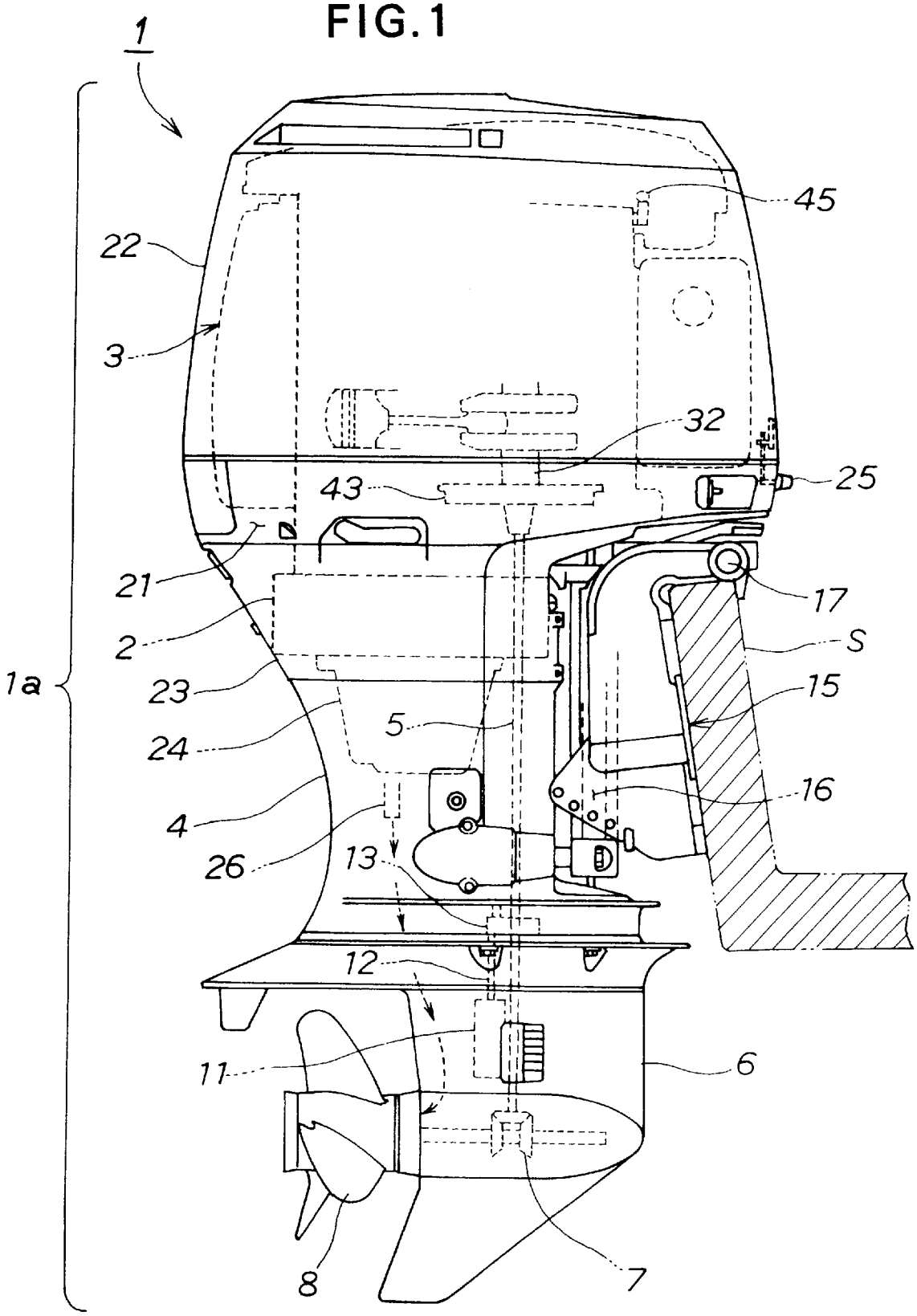
FIG. 1 is a side elevational view of an outboard motor according to the present invention.

As shown in FIG. 1, an outboard engine or motor 1 comprises an outboard motor body 1*a* and an outboard motor attachment mechanism 15*f* or attaching the outboard motor body 1*a* to the stern of a hull S.

The outboard motor body 1*a* is equipped with a vertical multicylinder engine 3 mounted on an engine mount case (engine support case) 2. An extension case 4 is disposed below the engine mount case 2 to define therein an exhaust expansion chamber. A vertical drive shaft 5 extends vertically through an internal space of the extension case 4 for transmitting the power of the engine 3 to a propeller 8.

A gearcase 6 is connected to a lower end of the extension case 4 and houses therein a bevel gear set 7 for switching or changing over the forward and backward movements of the hull S. The bevel gear set 7 has an output shaft to which the propeller 8 is firmly connected so that the propeller 8 is rotatably driven by the engine power transmitted via the vertical drive shaft 5. The gearcase 6 also houses a cooling water screen 11 which is connected by a cooling water supply pipe 12 to a water pump 13 disposed in the internal space of the extension case 4.

The outboard motor attachment mechanism 15 is a fixture assembly used for securing the outboard motor body 1*a* to the stem of the hull S. The attachment mechanism 15 supports the motor body 1*a* such that the motor body 1*a* can swing in the lateral direction about a vertical swivel shaft 16. The mechanism 15 can also tilt up and down about a horizontal tilt shaft 17.

The engine 3 is covered jointly by an undercase 21 and an engine cover 22. The undercase 21 and the engine cover 22 are detachably connected together by a lock mechanism 25. The undercase 21 has a lower end held in contact with an upper end of an undercover 23 which is provided to cover the mount case 2. The undercover 23 has the function of a decorative or ornamental cover. An oil pan 24 is connected to a lower end of the mount case 2.

Figure 2:
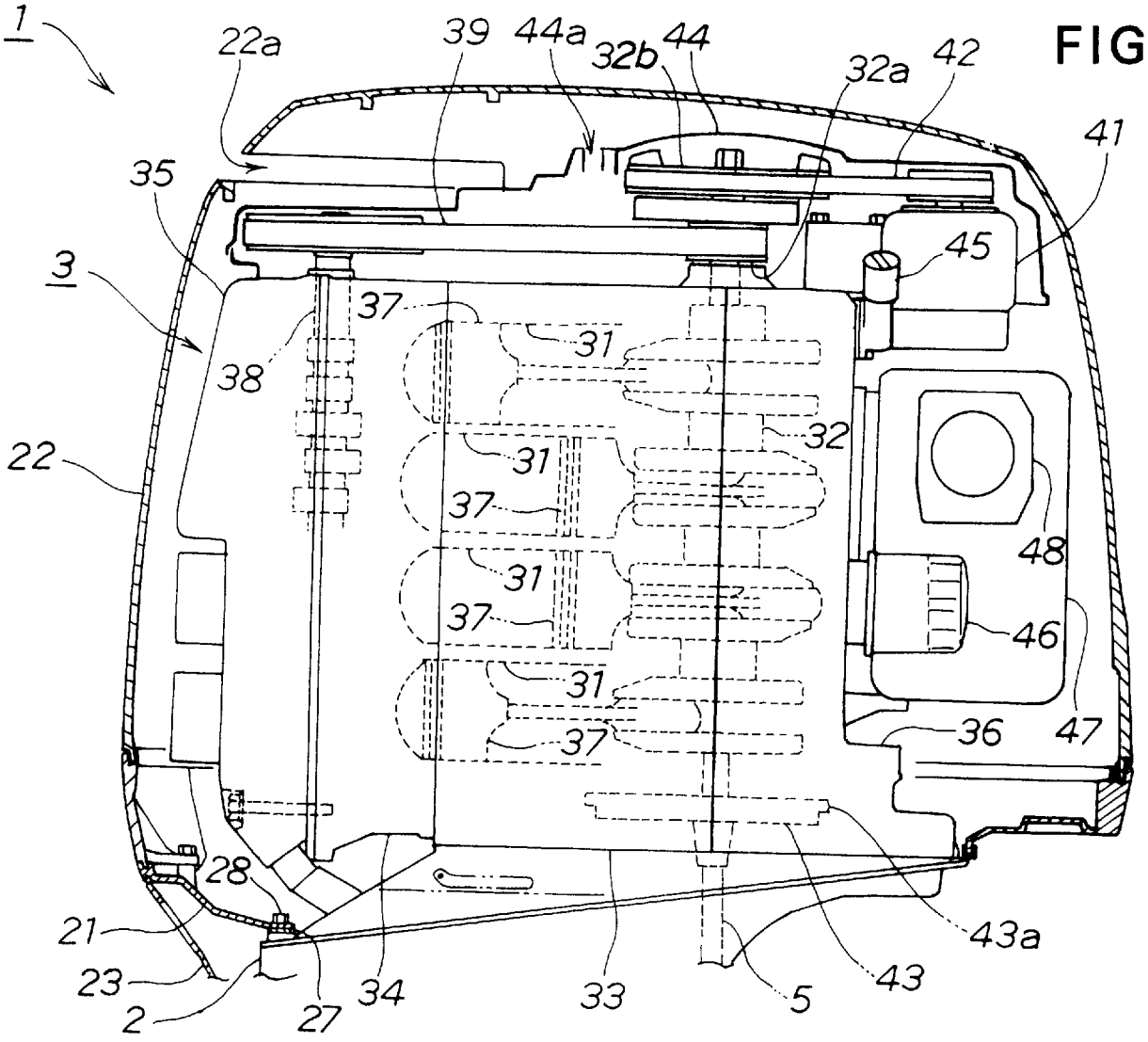
FIG. 2 is a side elevational view illustrating, partly in section, a vertical multicylinder engine of the outboard motor of FIG. 1.

As shown in FIG. 2, the vertical multicylinder engine 3 is a multicylinder four-stroke water-cooled engine with four cylinders 31 disposed horizontally in vertical juxtaposition and a crankshaft 32 disposed vertically. With the engine thus arranged, a cylinder block 33 and a cylinder head 34 have respective joining surfaces lying substantially vertically, and the cylinder head 34 and a head cover 35 have respective joining surfaces (mating surfaces) lying in a substantially vertical plane.

The engine 3 is disposed horizontally with its cylinder head 34 and head cover 35 located at the rear side (left-hand side of FIG. 1) of the outboard motor 1.

In FIG. 2, reference numeral 36 denotes a crankcase bolted to the cylinder block 33, and reference numeral 37 denotes a piston slidable in each cylinder 31.

Figure 4:
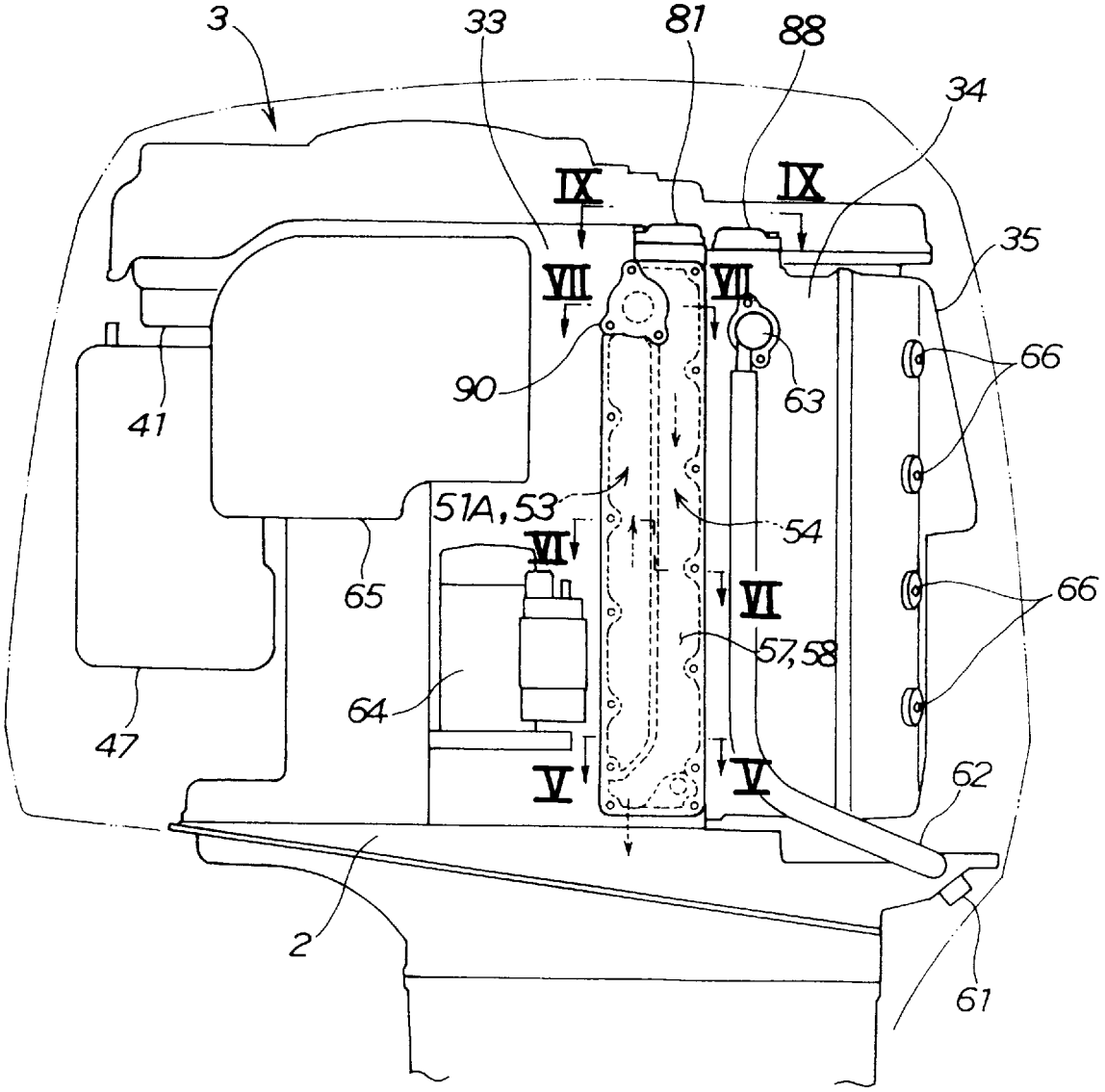
FIG. 4 is a schematic view illustrating the general arrangement of the vertical multicylinder engine.

The crank shaft 32 has an upper end to which a first pulley 32*a* and a second pulley 32*b* are connected one behind the other. The crankshaft 32 drives a camshaft 38 via a first endless belt 39 trained around the first pulley 32*a* and crankshaft pulley (not designated). The crankshaft 32 also drives an alternator 41 via a second endless belt 42 trained around the second pulley 32*b* and an alternator pulley (not designated). The first and second endless belts 39, 42 are covered by a belt cover 44. The belt cover 44 has formed therein a ventilating hole or opening 44*a* through which air inside the belt cover 44 is driven out to the outside of the engine cover 22. The engine cover 22 has an air intake hole 22*a* formed at an upper portion thereof. The crankshaft 32 has a lower end to which a flywheel 43 with toothed ring 43*a* is attached for engagement with a pinion gear (not shown) on a starter motor 64 (FIG. 4).

An oil filler hole 45 is provided in an inclined condition at a front surface of the crankcase 36. Reference numeral 46 denotes an oil filter; 47 denotes an intake sileneer (induction box) defining therein a silencer chamber; and 48 denotes a throttle valve device.

The undercase 21 is bolted to the mount case 2 with a rubber vibration isolator 27 disposed therebetween.

Figure 3:
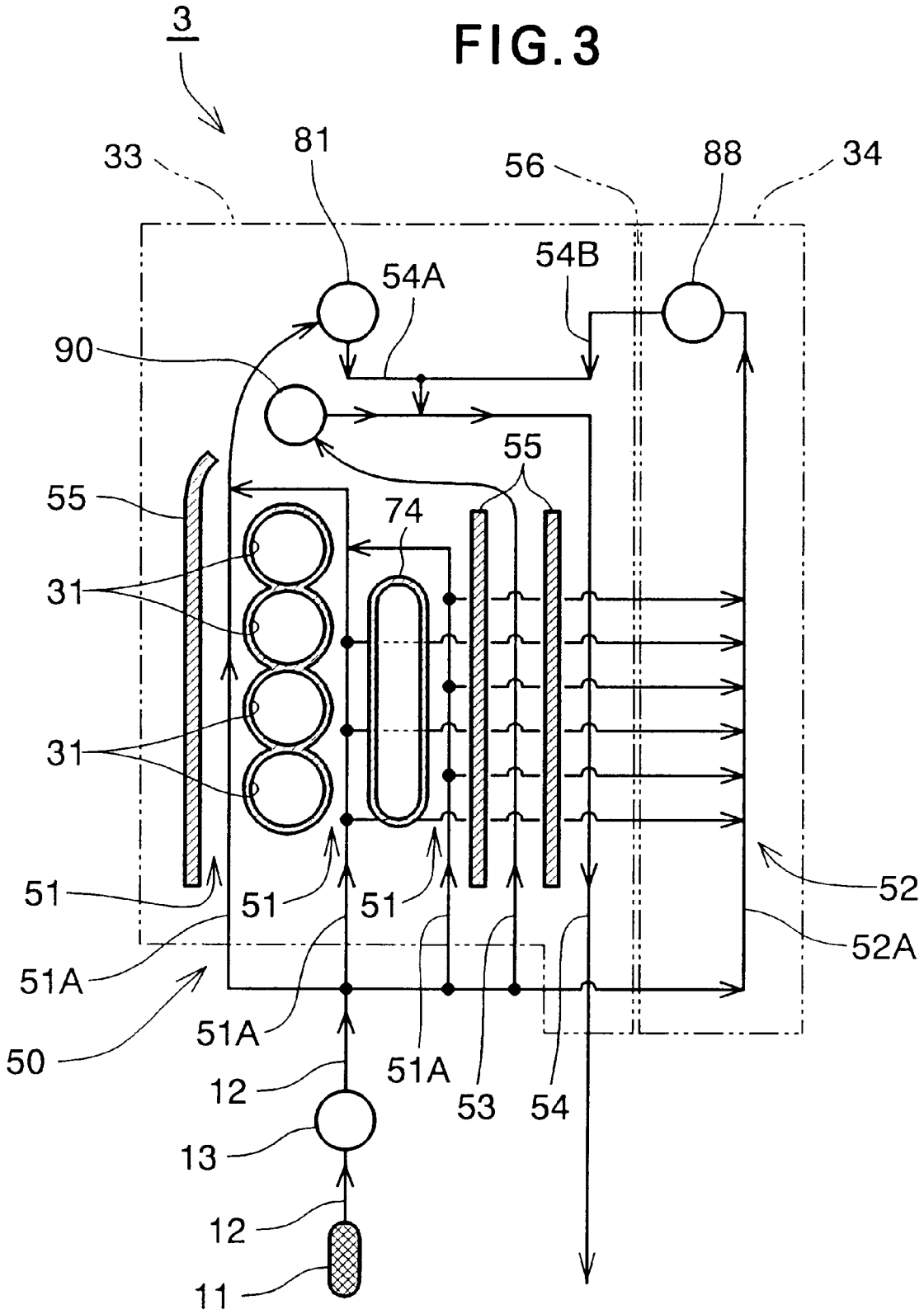
FIG. 3 is a diagrammatical view showing a cooling water passage of the engine of FIG. 2.

FIG. 3 diagrammatically shows a cooling water passage in the vertical multicylinder engine 3.

The engine 3 has a cooling water passage 50 connected to the cooling water supply pipe 12. The cooling water passage 50 is composed of a plurality of first cooling passages 51A formed by a water jacket 51 in the cylinder block 33 (hereinafter referred to as "second water jacket"), a second cooling passage 52A formed by a water jacket 52 in the cylinder head 34 (hereinafter referred to as "first water jacket"), a bypass passage 53, and drainage passage 54. The drainage passage 54 is provided to draw off the cooling water to the outside of the engine 3 after the cooling water flows past the first and second cooling passages 51A, 52A.

The first cooling passages 51A communicate with the drainage passage 54 via a first thermostat 81 and a drainage passage 54 provided downstream of the first thermostat 81. The second cooling passage 52A communicates with the drainage passage 54 via second thermostat 88 and a drainage portion 54B provide downstream of the second thermostat 88. The bypass passage 53 communicates with the drainage passage 54 via a relief valve 90.

The first thermostat 81 is a temperature-controlled valve which operates to open and close the first cooling passages 51A depending on the cooling water temperature inside the first cooling passages 51A. The second thermostat 88 is a temperature-controlled valve which operates to open and close the second cooling passage 52A depending on the cooling water temperature inside the second cooling passage 52A.

The relief valve 90 is a pressure-operated valve which operates to open and close the bypass passage 53 depending on the cooling water pressure inside the bypass passage 53, that is, the first and second cooling passages 51A, 52A.

In FIG. 3, reference numeral 55 designates a plurality of walls provided in the cylinder block 33 to define the cooling water passage 50; and 56 denotes a gasket disposed between respective contact or joining surfaces of the cylinder block 33 and the cylinder head 34, to provide a hermetic seal between the cylinder block and the cylinder head 34.

FIG. 4 is a side elevational view of the vertical multicylinder engine 3 of FIG. 2 as seen from an opposite or rear side.

As shown in FIG. 4, the first thermostat 81, which is incorporated in the cooling water passage 50 of the engine 3 together with the second thermostat 88 and the relief valve 90, is disposed on an upper surface of the cylinder block 33. The relief valve 90 is disposed adjacent to the first thermostat 81 and located on an upper part of one side surface of the cylinder block 33. The second thermostat 88 is disposed on an upper surface of the cylinder head 34.

Since the first and second thermostats 81, 88 are disposed on the upper surface of the cylinder block 33 and the upper surface of the cylinder head 34, respectively, the relief valve 90 can be mounted on the upper part of the side surface of the cylinder block 33.

More particularly, a part of the first cooling passage 51A, the bypass passage 53 and the drainage passage 54 are disposed on the same side (front side of the sheet of FIG. 4) of the cylinder block 33. This part of the first cooling passage 51A, the bypass passage 53 and the drainage 54 extend vertically and are covered by a housing 57 and a cover 58, as detailed later with reference to FIG. 5.

In order to enable the cooling water passage 50 to be cleaned or washed with washing water, the engine 3 further includes a washing water inlet 61, a hose 62, and a check valve 63. The check valve 63 is mounted on the cylinder head 34. In FIG. 4, reference numeral 64 denotes the starter motor described above; 65 denotes an electric equipment box; and 66 denotes ignition plugs.

Figure 5:
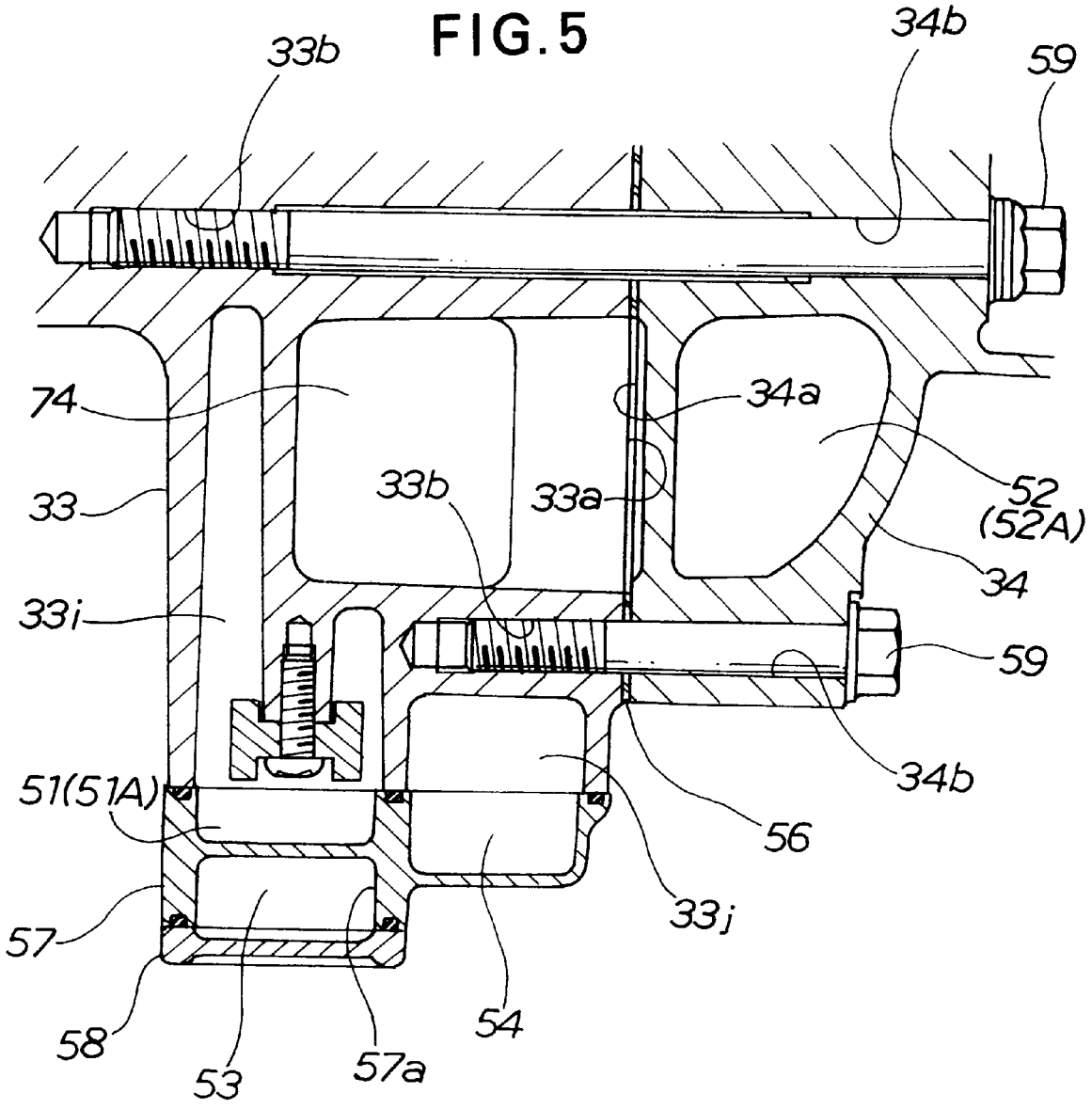
FIG. 5 is an enlarged cross-sectional view taken along line V—V of FIG. 4.

FIG. 5 is an enlarged cross-sectional view taken along line V—V of FIG. 4. As shown in this figure, the cylinder block 33 has two vertically elongated recessed portions 33*i*, 33*j* formed in lateral juxtaposition in the side surface of the cylinder block 33. Respective front sides (open sides) of the recessed portions 33*i*, 33*j* are closed by the housing 57. The above-mentioned part of the first cooling passage 51A is defined jointly by the recessed portion 33*i* and the housing 57. The drainage passage 54 is defined jointly by the recessed portion 33*i* and the housing 57. The housing 57 has a vertically elongated recessed portion 57*a* formed in a left side portion of the front surface of the housing 57. The front side (open side) of the recessed portion 57*a* is closed by the cover 58. The cover 58 and the recessed portion 57*a* jointly define the bypass passage 53.

As described later, the cylinder block 33 is coupled to the cylinder head 34 by screwing a plurality of bolts 59, 59 into screw openings 33*b*, 33*b* through bolt inserting openings 34*b*, 34*b*.

Figure 6:
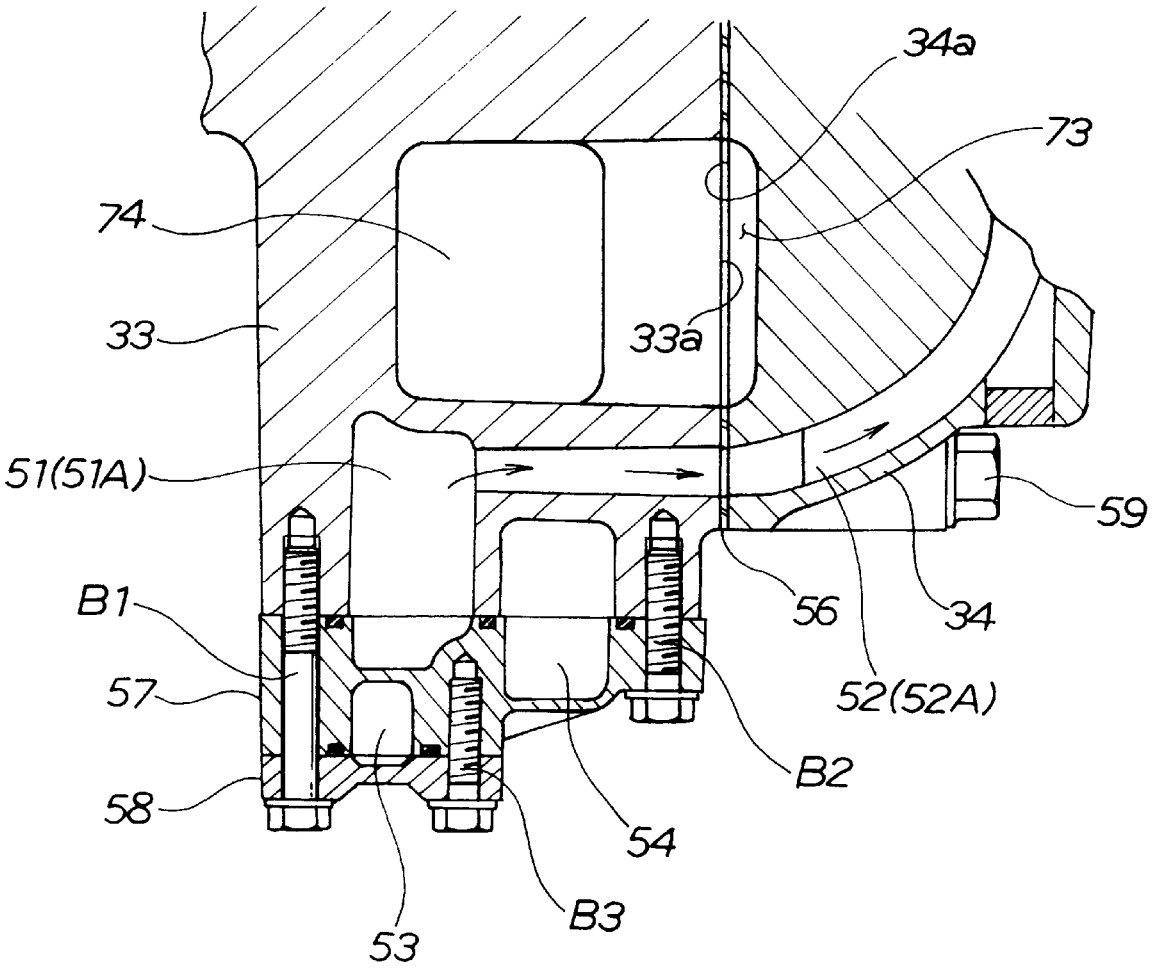
FIG. 6 is an enlarged cross-sectional view taken along line VI—VI of FIG. 4.

FIG. 6 is an enlarged cross-sectional view taken along line VI—VI of FIG. 4, showing the second water jacket 51 (the first cooling passage 51A) which communicates with the first water jacket 52 (the second cooling passage 52A). As shown in this figure, the housing 57 is secured by two sets of bolts B1 and B2 to the cylinder block 33 to thereby define, jointly with the cylinder block 33, the first cooling passage 51A and the drainage passage 54. The cover 58 is secured to the housing 57 by the bolts B1 and a set of bolts B3 to thereby define, jointly with the housing 57, the bypass passage 53.

Figure 7:
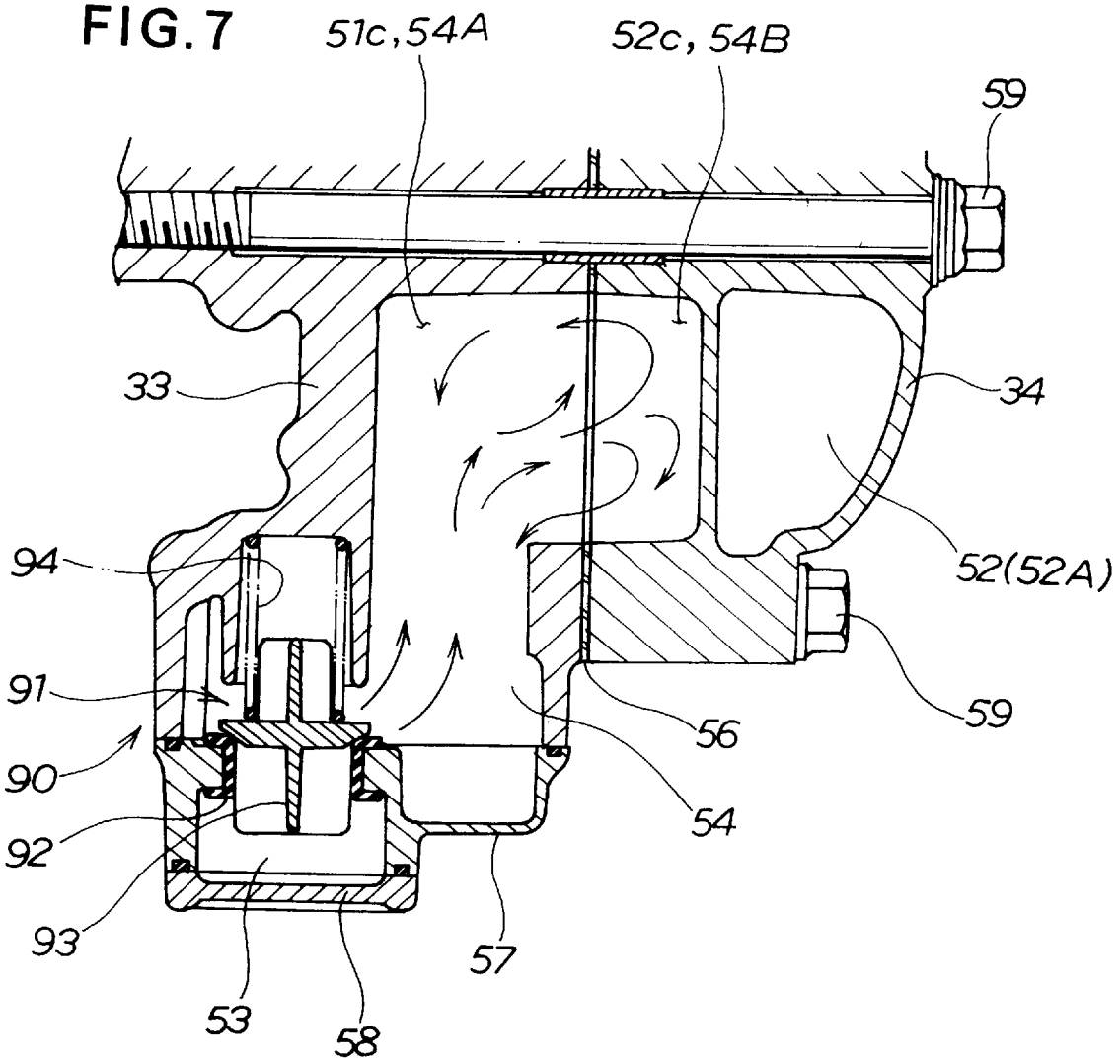
FIG. 7 is an enlarged cross-sectional view taken along line VII—VII of FIG. 4.

FIG. 7 is an enlarged cross-sectional view taken along line VII—VII of FIG. 4. As shown in this figure, the relief valve 90 is comprised of a valve chamber 91, a valve seat 92, a valve member 93 and a valve spring 94. The valve chamber 91 is formed at a position or junction where the bypass passage 53 and the drainage passage 54 communicate with each other. The valve seat 92 is attached to the housing 57 at that portion of the bypass passage 53 which forms a part of the valve chamber 91. The valve seat 92 is made of rubber or synthetic resin so as to produce a desired water-tightness between itself and the valve member 93 when the valve member 93 is seated against the valve seat 92. The valve member 93 has a cruciform section and is disposed in the valve chamber 91 such that a disk-like portion of the valve member 93 is movable into and away from sealing engagement with the valve seat 92. The valve spring 94 comprises a compression spring and acts between the cylinder block 33 and the valve member 93 to normally urge the valve member 93 in a direction to close the valve chamber 91. The relief valve 90 operates such that when the pressure of the cooling water coming from the bypass passage 53 exceeds a predetermined pressure, the valve member 93 separates from the valve seat 92 against the force of the valve spring 94 to thereby place the bypass passage 53 and the drainage passage 54 in fluid communication with each other.

Figure 8:
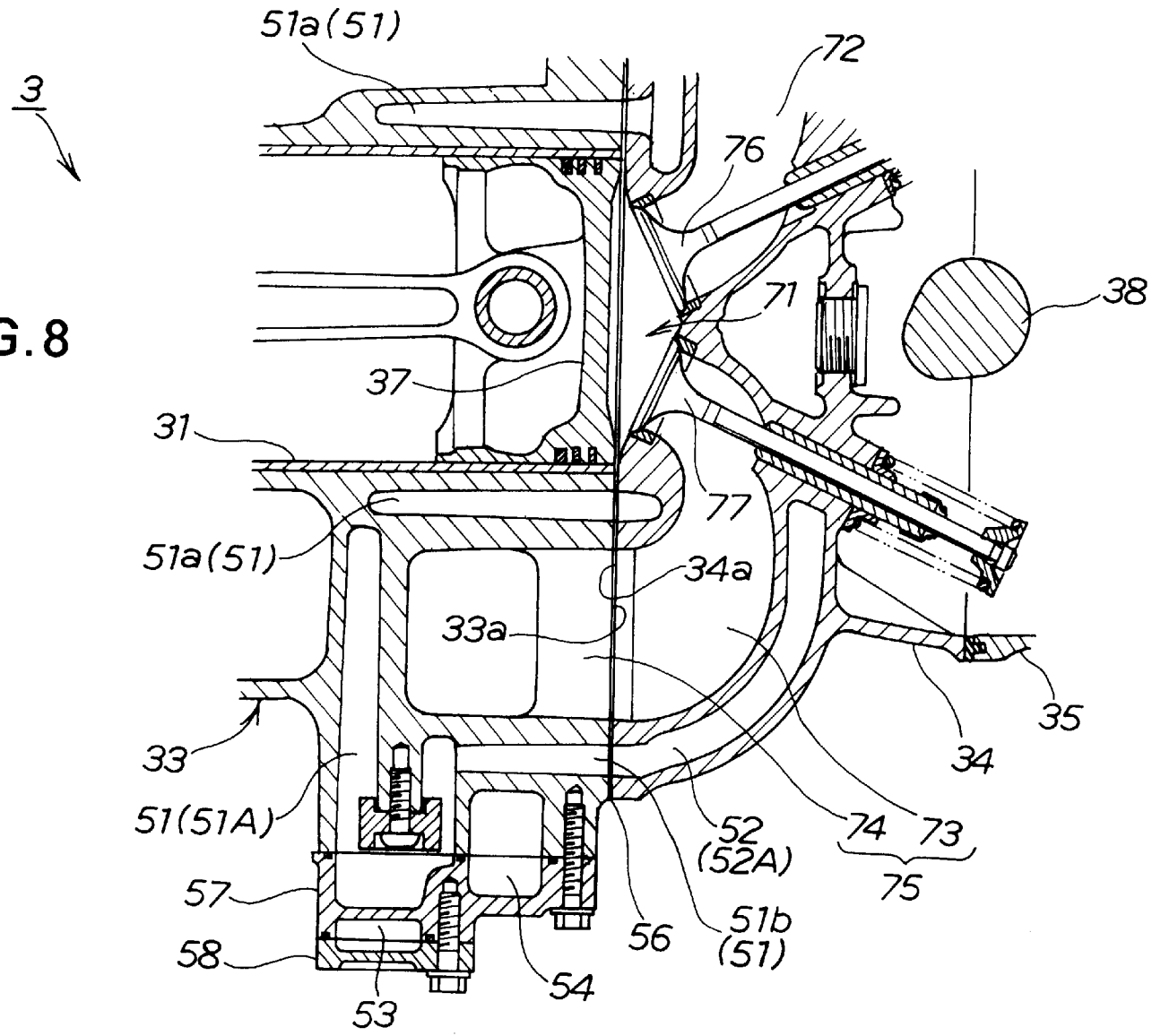
FIG. 8 is a cross-sectional view showing an essential part of the engine.

FIG. 8 is a cross-sectional view taken along an axis of a second cylinder 31 (the one next to the uppermost cylinder in FIG. 2), showing an essential part of the engine according to the present invention.

The cylinder block 33 is coupled by the bolts 59 shown in FIG. 5 to the cylinder head 34 with their joining surfaces 33*a*, 34*a* mated together via the gasket 56. The cylinder block 33 and the cylinder head 34 have a plurality of combustion chambers 71 arranged in vertical juxtaposition.

The cylinder head 34 includes head intake passages 72 for guiding an intake air to the respective combustion chambers 71, first or head exhaust passages 73 for guiding an exhaust air from the respective combustion chambers 71, and the first water jacket 52. The first water jacket comprises jacket portions disposed around the combustion chambers 71 for cooling the vicinity of the combustion chambers 71 and the vicinity of the first exhaust passages 73.

The cylinder block 33 includes a second or block exhaust passage 74 which communicates with the first exhaust passages 73, and the second water jacket 51. The second water jacket comprises jacket portions disposed around the combustion chambers 71 for cooling the vicinity of the combustion chambers 71 and the vicinity of the second exhaust passage 74. The first exhaust passages 73 and the second exhaust passage 74 jointly form an exhaust passage 75. The exhaust air flows from the exhaust passage 75 to the outside of the outboard motor 1 via an exhaust tube 26 shown in FIG. 1. Reference numeral 76 denotes an inlet valve. Reference numeral 77 denotes an exhaust valve.

Figure 9:
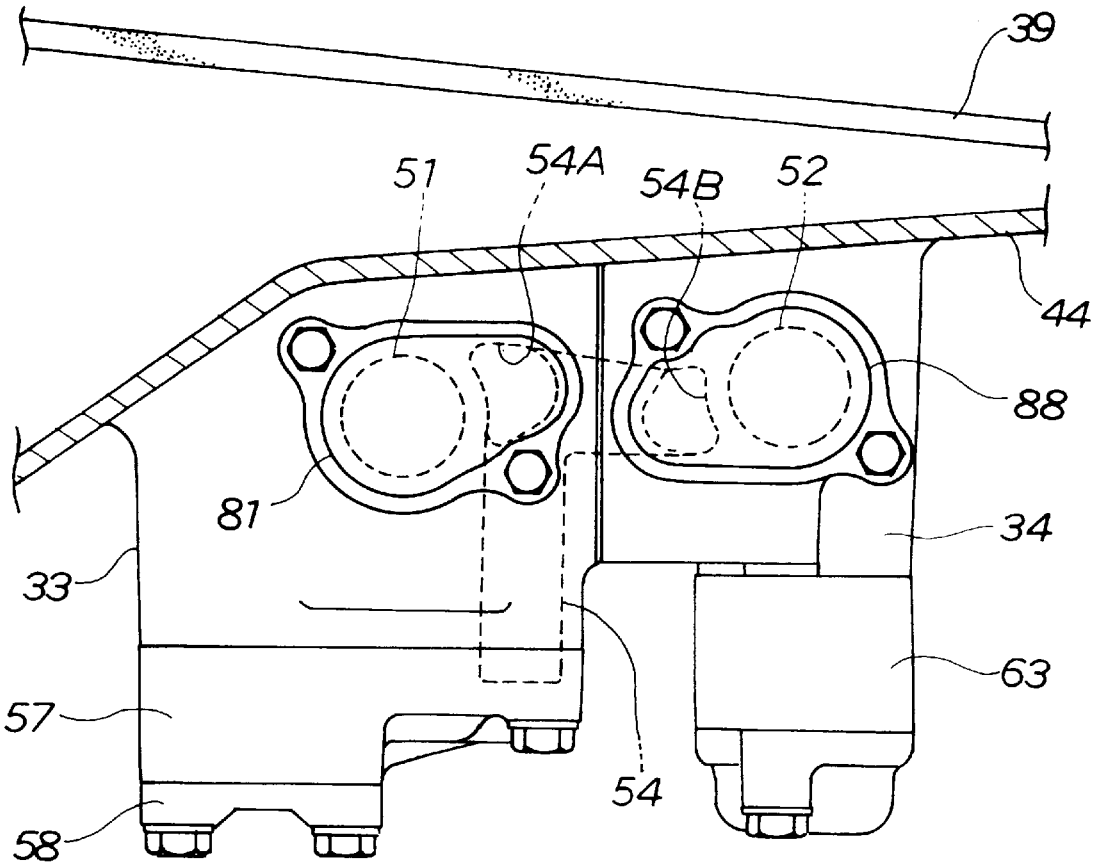
FIG. 9 is an enlarged plan view as seen from line IX—IX of FIG. 4.

FIG. 9 is an enlarged plan view taken along line IX—IX of FIG. 4, showing the first thermostat 81 mounted on an upper surface of the cylinder block 33 and the second thermostat 88 mounted on an upper surface of the cylinder head 34.

As shown in FIG. 9, the first and second thermostats 81, 88 are disposed adjacent to each other, with their drainage portions 54A, 54B disposed in confronting relation to each other so that the two thermostats can use the same drainage passage 54 in common via the drainage portions 54A, 54B. The first and second thermostats 81, 88 mounted on the respective upper surfaces of the cylinder block 33 and the cylinder head 34 are arranged so as not to interfere with the first endless belt 39 and the belt cover 44.

Figure 10:
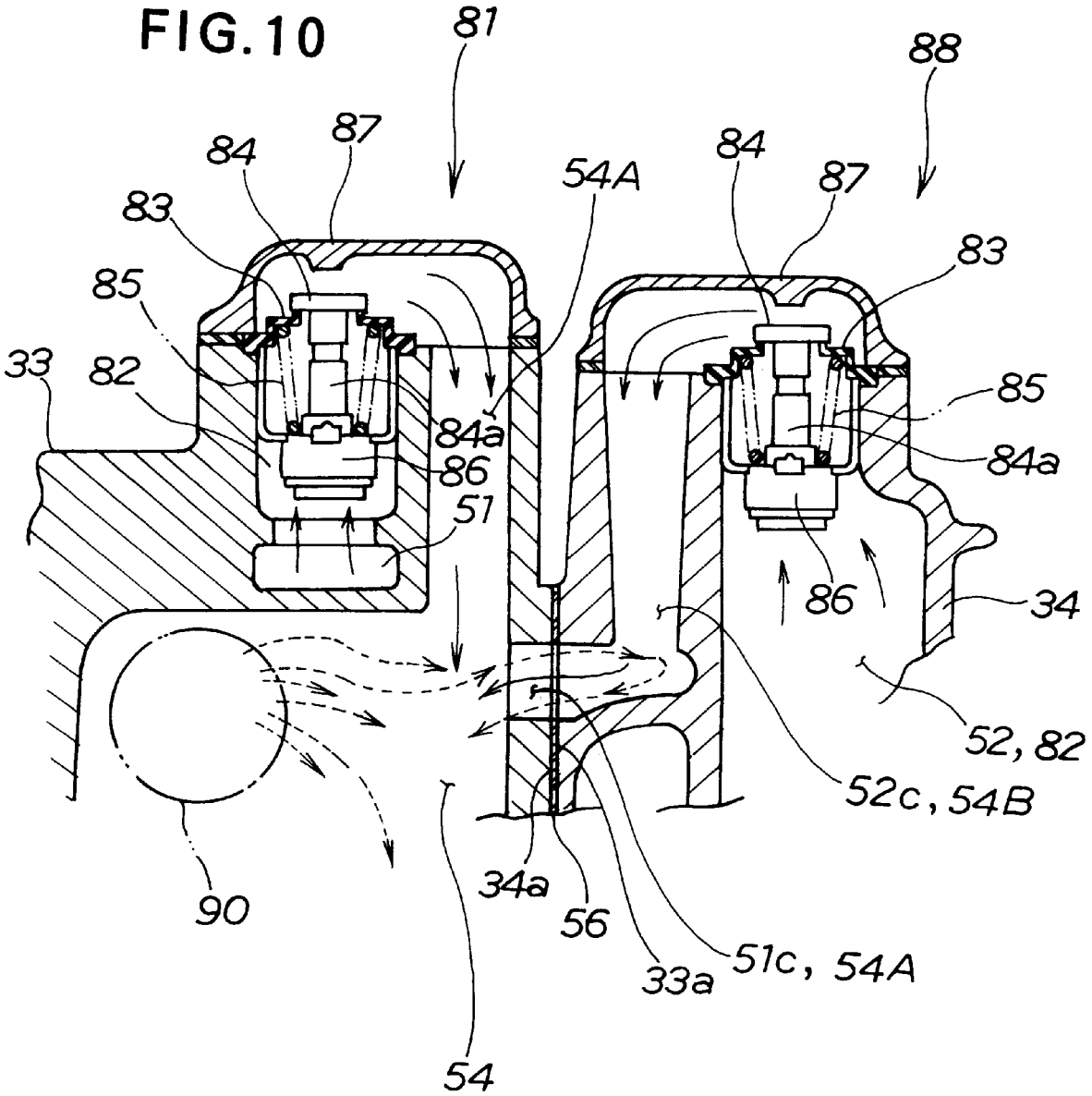
FIG. 10 is a cross-sectional view of first and second thermostats shown in FIG. 9.

FIG. 10 is a cross-sectional view illustrating the first and second thermostats 81, 88 with the drainage portions 54A, 54B provided downstream thereof and communicating with the drainage passage 54 disposed downstream of the relief valve 90.

The first thermostat 81 is of the so-called "wax" type which operates using the temperature-dependent volumetric difference (by expansion and contraction) of a paraffin. The thermostat 81 is comprised of a valve chamber 82, a valve seat 83, a valve member 84, a valve spring 85 and a wax holding portion or container 86. The valve chamber 82 is defined in the cylinder block 33 and communicates with the second water jacket 51. The valve seat 83 is made of a rubber or synthetic resin material to provide a hermetic seal and is disposed the upper surface of the cylinder block 33. The valve member 84 is provided in such a manner as to close an opening in the valve seat 83 and is connected to the wax container 86 via a rod 84*a*. The valve spring 85 is a compression spring normally urging the valve member 84 in a direction to close the opening in the valve seat 83. A cover 87 extends generally from the valve chamber 82 to the drainage portion 54A. In the first thermostat 81, when the temperature of the cooling water in the second water jacket 51 rises over a preset value, the wax in the wax container 86 expands. This expansion causes the rod 84*a* to move, thereby opening the valve member 84 against the resilient force of the compression spring 85 so that the second water jacket 51 and the drainage passage 54A communicate with each other.

The second thermostat 88 has the same construction as the first thermostat 81.

The drainage portion 54A provided downstream of the first thermostat 81 also serves as a third jacket portion 51*c* formed in the joining surface 33*a* of the cylinder block 33. The drainage portion 54B provided downstream of the second thermostat 88 also serves as a third jacket portion 52*c* formed in the joining surface 34*a* of the cylinder head 34. Thus, the third jacket portions 51*c*, 52*c* communicate with the drainage passage 54 provided downstream of the relief valve 90.

Figure 11:
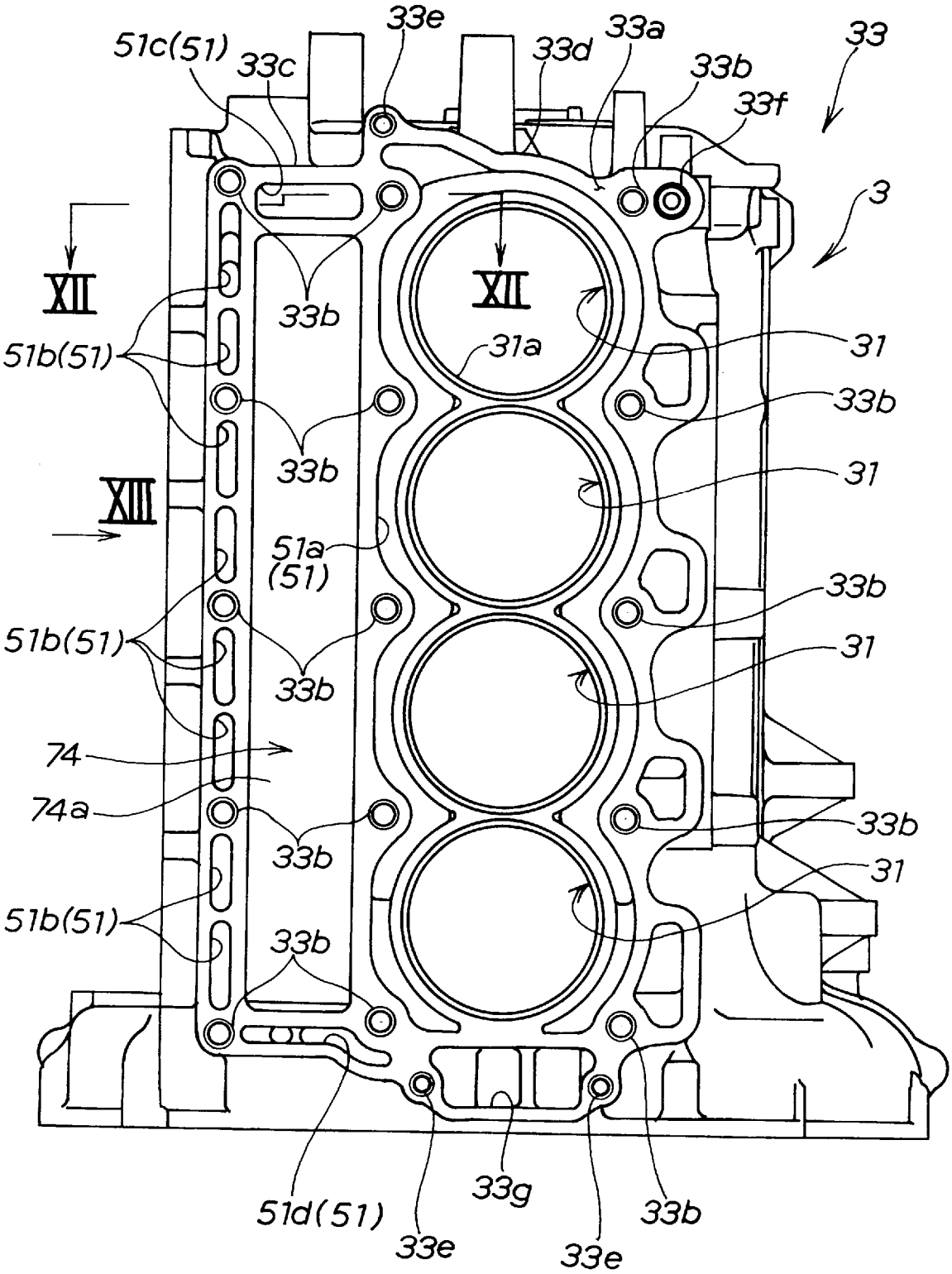
FIG. 11 is a side elevational view of a cylinder block of the engine.

FIG. 11 is a side elevational view illustrating the cylinder block 33, as viewed from the side of the joining surface 33*a* thereof, with the cylinders 31 (four shown in this figure) disposed horizontally in vertical juxtaposition.

The second exhaust passage 74 has a vertically elongate opening 74*a* formed in the joining surface 33*a* such that it opens in the direction of juxtaposition of the cylinders 31. In the joining surface 33*a* around the opening 74*a*, the screw openings 33*b* are formed for receiving the bolts 59 shown in FIG. 5. That is, the cylinder block 33 has the screw openings 33*b* formed in the joining surface 33*a* such that they surround the openings of the cylinders 31 and the opening 74*a* of the second exhaust passage 74. As shown in FIG. 5, the joining surface 33*a* of the cylinder block 33 is joined or mated with the joining surface 34*a* of the cylinder head 34 via the screw openings 33*b* and the bolts 59.

The cylinder block 33 has a plurality of screw openings (taps) 33*c* formed at top and bottom outermost (overhung) positions of the cylinder block 33. The cylinder block 33 and the cylinder head 34 are also connected together via the screw openings 33*e* and the bolts threadedly received therein.

The second water jacket 51 has the jacket portions disposed between the screw openings 33*b* in such a manner as to surround the opening 74*a* of the second exhaust passage 74.

More specifically, the second water jacket 51 is composed of a first jacket portion 51*a* surrounding the cylinders 31, a plurality of second jacket portions 51*b* surrounding a left side of the second exhaust passage 74, a third jacket portion 51*c* surrounding an upper side of the second exhaust passage 74, and a fourth jacket portion 51*d* surrounding a lower side of the second exhaust passage 74.

The opening 74*a* of the second exhaust passage 74 has a ceiling wall positioned lower than a top portion of a liner 31*a* of the first or uppermost cylinder 31. This arrangement enables an upper wall 33*c* of the third jacket portion 51*c* to be positioned lower than an upper wall 33*d* defining part of the first cylinder 31, thereby meeting a requirement for making the engine 3 compact. That is, it is not necessary for the cylinder block 33 to have an increased height so as to provide the third jacket portion 51*c*. It thus becomes possible to provide the third jacket portion 51*c*, which surrounds the upper part of the second exhaust passage 74, while maintaining the height of the engine 3 constant. In the figure, reference characters 33*f* and 33*g* denote oil passages.

Figure 12:
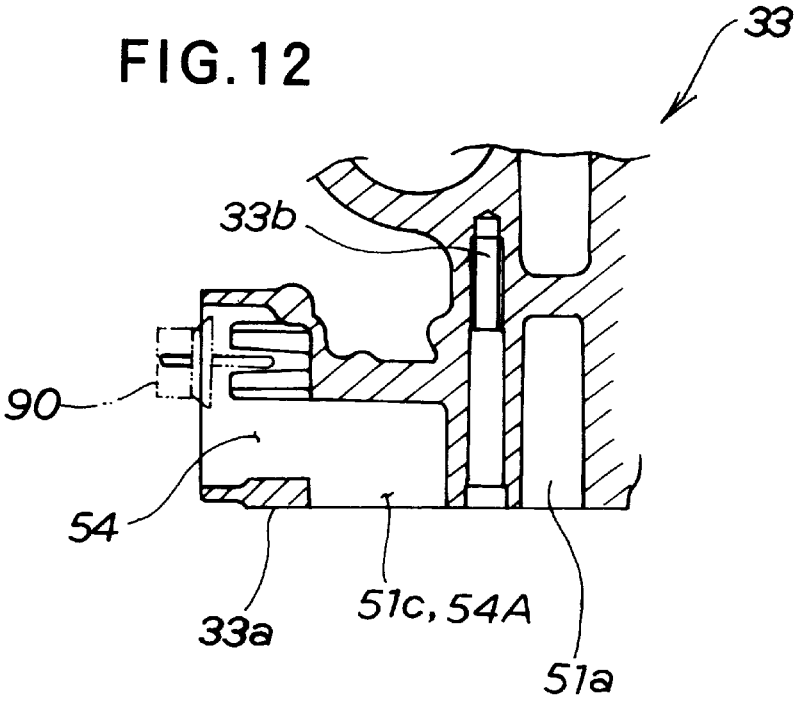
FIG. 12 is a cross-sectional view taken along line XII—XII of FIG. 11.

FIG. 12 is a cross-sectional view taken along line XII—XII of FIG. 11, showing the third jacket portion 51*c* (i.e., the drainage passage 54A provided downstream of the first thermostat 81) communicating with the drainage passage 54 positioned downstream of the relief valve 90.

Figure 13:
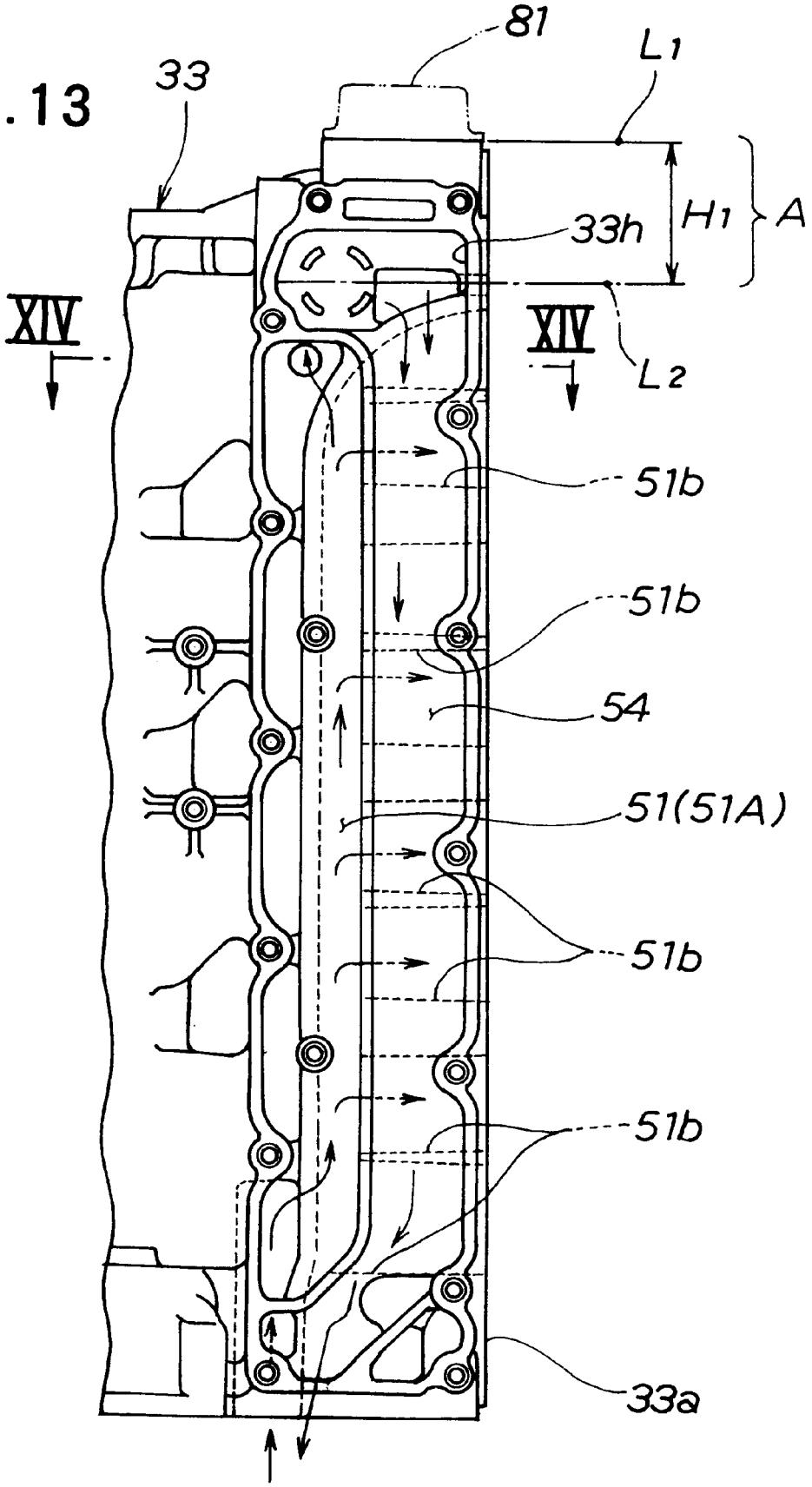
FIG. 13 is a view as seen in the direction of arrow XIII of FIG. 11.

FIG. 13 is a side elevational view of the cylinder block 33 as viewed from the direction of arrow XIII of FIG. 11, showing a portion of the first cooling passage 51A and the drainage passage 54 formed in the side of the cylinder block 33.

The first thermostat 81 indicated by phantom lines is mounted upwardly of the drainage passage 54 and, more particularly, to the upper surface (hereinafter referred to as "thermostat level L1") of the cylinder block 33. The relief valve 90 shown in FIG. 4 is mounted adjacent to an upper part of the drainage passage 54 and, more particularly, to the upper portion (hereinafter referred to as "relief valve level L2") of the side surface of the cylinder block 33, which is proximate to the thermostat level L1. The thermostat level L1 and the relief valve level L2 are vertically spaced from each other by a distance H1. An upper end portion of the cylinder block 33 between the thermostat level L1 and the relief valve level L2 will be hereinafter referred to as "isolated portion A".

Since the relief valve 90 is positioned closely to the first and second thermostats 81, 88 as shown in FIG. 4, the distance H1 between the first and second thermostats 81, 88 and the relief valve 90 is very small. Thus, even under a condition that the first and second thermostats 81, 88 are closed, the relief valve 90 is opened to allow the cooling water to flow through the drainage passage 54. This achieves a sufficient cooling effect throughout the entire area of the drainage passage 54, including a wall 33*h* of the isolated portion A. As a result, the drainage passage 54 is kept at a uniform temperature throughout the length thereof. This further enables an area along the joining surfaces 33*a*, 34*a* (see FIG. 10) of the cylinder block 33 and the cylinder head 34 to have a uniform temperature.

Thus, even when the pitch of the bolts 59 (see FIG. 5) for connecting the cylinder block 33 and the cylinder head 34 is increased due to the large-sized cylinder bore necessitated by the up-sizing of the engine, it is possible to attain a cooling function with respect to the joining surfaces 33*a*, 33*a*.

Figure 14:
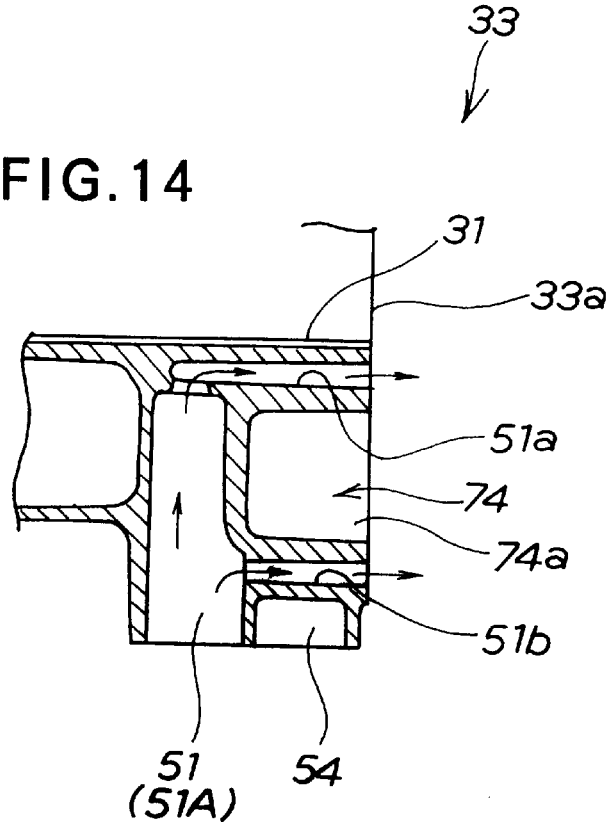
FIG. 14 is a cross-sectional view taken along line XIV—XIV of FIG. 13.

FIG. 14 is a cross-sectional view taken along line XIV—XIV of FIG. 13, showing the second water jacket 51 divided into jacket portions composed of the first jacket portion 51*a* and the second jacket portion 51*b*.

Figure 15:
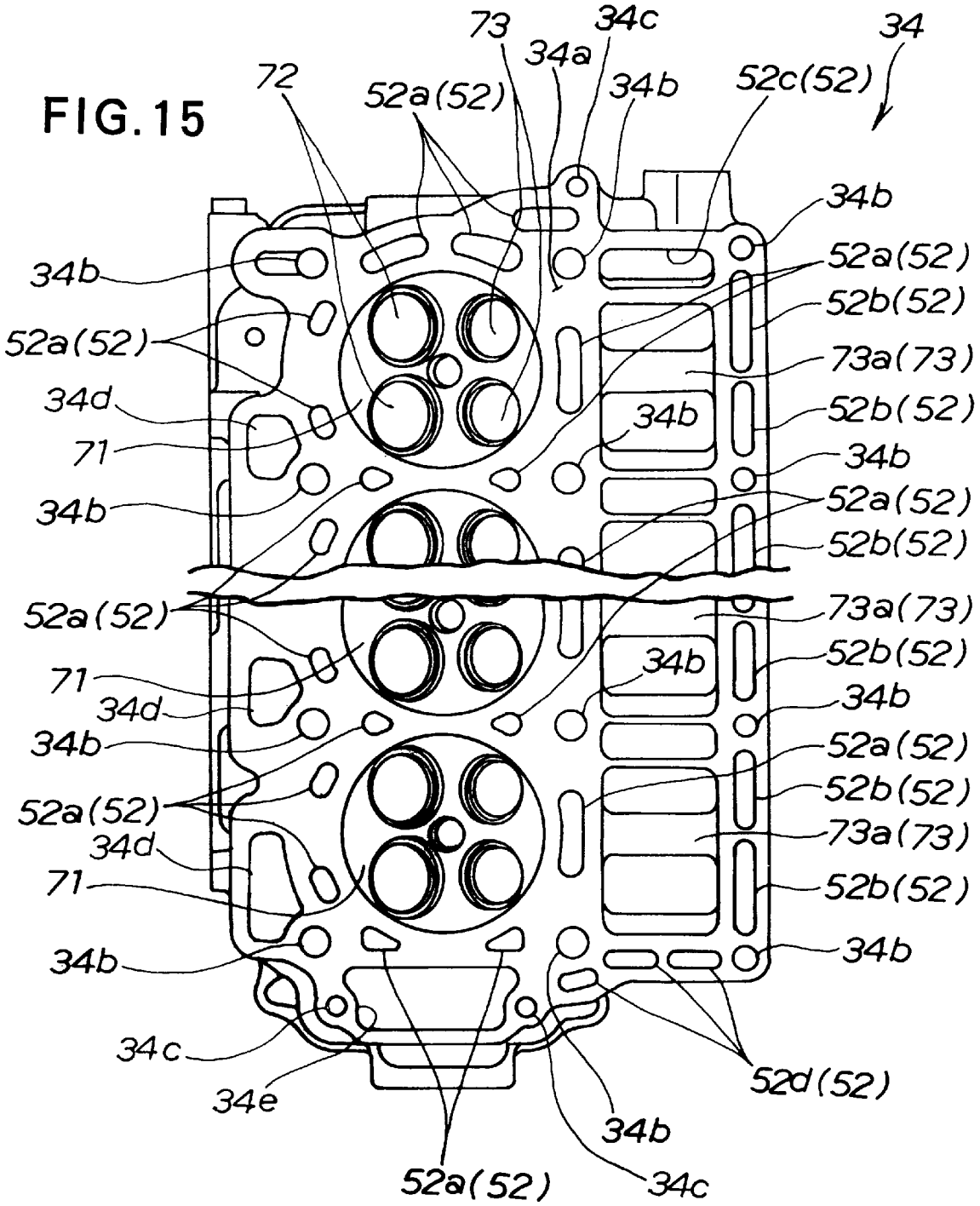
FIG. 15 is a side elevational view of the cylinder head of the engine.

FIG. 15 is a side elevational view of the cylinder head 34 as viewed from the side of the joining surface 34*a* thereof, showing the combustion chambers 71 arranged in vertical juxtaposition.

The first exhaust passages 73 have openings 73*a* which open at the joining surface 34*a* of the cylinder head 34 along the combustion chambers 71 and are surrounded by the bolts 59 as shown in FIG. 5. In the joining surface 34*a* of the cylinder head 34, there are formed the bolt receiving openings 34*b* disposed around the openings of the combustion chambers 71 and the openings 73*a* of the first exhaust passages 73. The cylinder block 33 (see FIG. 11) and the cylinder head 34 are coupled together by screwing the bolts 59 (see FIG. 5) into the screw openings 33*b* (see FIG. 11) through the bolt receiving openings 34*b*.

The cylinder head 34 has a plurality of bolt receiving openings 34*c* formed at the top and bottom outermost positions (overhung positions) of the joining surface 34*a*. The cylinder block 34 (see FIG. 11) and the cylinder head 34 are also connected together by the bolts 59 engaged in the bolt receiving openings 34*c* and screwed into the screw openings 33*e*.

The first water jacket 52 is composed of a plurality of first jacket portions 52*a* disposed around the respective combustion chambers 71, a plurality of second jacket portions 52*b* provided in a row at a right side of the openings 73*a* of the vertically arranged first exhaust passages 73, a third jacket portion 52*c* disposed above the first exhaust passage 73, and a plurality of fourth jacket portions 52*d* disposed below the first exhaust passage 73. In other words, the jacket portions of the first water jacket 52 are so arranged as to surround the combustion chambers 71 and the openings 73*a* of the first exhaust passages 73. Accordingly, the vicinity of the openings 73*a* of the first exhaust passages 73 and the vicinity of the opening 74*a* (see FIG. 11) of the second exhaust passage 74 are equally cooled to thereby suppress distortion by exhaust heat of the vicinity of the openings 73*a*, 74*a*. Thus, it becomes possible to produce a sufficient seal between the joining surface 33*a* of the cylinder block 33 and the joining surface 34*a* of the cylinder head 34.

When the cylinder block 33 and the cylinder head 34 are coupled together, the third jacket portion 52*c* disposed above the uppermost first exhaust passage 73 communicates with the third jacket portion 51*c* shown in FIG. 10. This also causes the third jacket portion 52*c* (ie., the drainage portion 54B provided downstream of the second thermostat 88) to communicate with the drainage 54 passage provided downstream of the relief valve 90.

The drainage portions 54A, 54B are located downstream of the first and second thermostats 81, 88. The third jacket portions 51*c*, 52*c* are arranged to communicate with the drainage passage 54 provided downstream of the relief valve 90. When the relief valve 90 is opened to allow the cooling water to flow through the drainage passage 54, the cooling water flows into the third jacket portions 51*c*, 52*c*, as shown in FIGS. 7 and 10. Since the third jacket portions 51*c*, 52*c* are cooled by the flowing cooling water, a sufficient cooling effect can be attained throughout the entire area of the joining surfaces 33*a*, 34*a* around the drainage passage 75 (see FIG. 8). As a result, it becomes possible to maintain at a uniform temperature the wall defining the drainage passage 54 and the engine portion along the joining surfaces 33*a*, 34*a* of the cylinder head 33 and the cylinder head 34. In FIG. 15, reference character 34*d* designates a breather passage; and 34*e* denotes an oil passage.

It may be readily appreciated by those skilled in the art that in the present invention, the first thermostat 81 may be mounted on the upper surface of the cylinder block 33 while the relief valve 90 may be mounted on the side surface of the cylinder block 33 proximately to the first thermostat 81. For example, the first thermostat 81 and the relief valve 90 may be mounted directly or indirectly onto the cylinder block 33.

Obviously, various minor changes and modifications of the present invention are possible in the light of the above teaching. It is therefore to be understood that within the scope of the appended claims the invention may be practiced otherwise than as specifically described.

What is claimed is:

1. An engine cooling system for an outboard motor having a top side and a bottom side, comprising:

a cylinder block having a plurality of cylinders disposed generally horizontally in vertical juxtaposition;

a cylinder head being capable of coupling with said cylinder block;

a plurality of combustion chambers defined in said cylinder block and said cylinder head;

first exhaust passages formed in said cylinder head for guiding an exhaust gas from said combustion chambers;

a second exhaust passage formed in said cylinder block in such a manner as to communicate with said first exhaust passages;

a first water jacket having jacket portions formed around said combustion chambers of said cylinder head;

a second water jacket having jacket portions formed around said combustion chambers of said cylinder block;

a cooling water passage comprising said first water jacket and said second water jacket, said cylinder block and said cylinder head having joining surfaces to be connected together by plural bolts;

said second exhaust passage located along a first side of said cylinders, having an opening which opens at said joining surface of said cylinder block and is surrounded by said bolts; and said cooling water passage having second and third sides, said second side facing said first side of said cylinders and said third side being opposite thereto, said cooling water passage having water jacket portions formed between said bolts in said joining surface of said cylinder block along said third side and said bottom side of said opening of said second exhaust passage, said cooling water passage further having water jacket portions formed between said bolts in said joining surface of said cylinder block along said top side of said opening of said second exhaust passage.

2. An engine cooling system for an outboard motor having an outboard motor upper part and an outboard motor lower part, comprising:

a cylinder block having a plurality of cylinders disposed generally horizontally in vertical juxtaposition;

a cylinder head for coupling with said cylinder block to define a plurality of combustion chambers;

first exhaust passages formed in said cylinder head for guiding an exhaust gas from said combustion chambers said first exhaust passages having first exhaust passages upper and lower parts;

a second exhaust passage formed in said cylinder block and communicating with said first exhaust passages, said second exhaust passages having second exhaust passages upper and lower parts;

a first water jacket having jacket portions for cooling the vicinity of said first exhaust passages including upper first water jacket portions for cooling the vicinity surrounding said first exhaust passage upper part;

a second water jacket having jacket portions for cooling the vicinity of said second exhaust passage including upper second water jacket portions for cooling the vicinity surrounding said second exhaust passage upper part; and a drain passage for draining water outside said motor from said first and second water jackets;

a relief valve actuated to open and close said second water jacket and said first water jacket by detecting the pressure of cooling water inside said water jackets, said relief valve being disposed adjacent to said upper first and second water jacket portions, wherein said upper portion of said second water jacket along an upper side of said second exhaust passage, and said upper portion of said first water jacket along an upper side of said first exhaust passage are directly connected together and communicate with said drainage passage provided downstream of said relief valve.

3. An engine cooling system for an outboard motor, as claimed in claim 2, wherein said first water jacket further serves to cool the vicinity of said combustion chambers of said cylinder head and has at least one thermostat mounted thereto and being capable of opening and closing actions by detecting a temperature of the cooling water within said first water jacket, and a drainage passage is provided downstream of said thermostat such that it communicates with said drainage passage positioned downstream of said relief valve.

4. An engine cooling system for an outboard motor, as claimed in claim 2, wherein said jacket portion of said second water jacket surrounding the upper side of said second exhaust passage has an upper wall positioned lower than an upper wall defining an uppermost one of said cylinders.

* * * * *